US005826247A

United States Patent [19]

Pintsov et al.

[11] Patent Number: 5,826,247

[45] Date of Patent: Oct. 20, 1998

[54] CLOSED LOOP TRANSACTION BASED MAIL ACCOUNTING AND PAYMENT SYSTEM WITH CARRIER PAYMENT THROUGH A THIRD PARTY INITIATED BY MAILING INFORMATION RELEASE

[75] Inventors: Leon A. Pintsov, W. Harford; William T. Shannon, Shelton, both of Conn.

[73] Assignee: Pitney Bowes Inc., Stamford, Conn.

[21] Appl. No.: 629,719

[22] Filed: Apr. 9, 1996

[51] Int. Cl.[6] ..... G07B 17/02

[52] U.S. Cl. ..... 705/404; 705/401

[58] Field of Search ..... 364/400, 464.14, 364/464.11, 464.02, 464.03; 395/239, 244; 705/39, 44, 404, 401

[56] References Cited

U.S. PATENT DOCUMENTS

| | | | |
|---|---|---|---|
| 4,757,537 | 7/1988 | Edelmann et al. | 380/51 |
| 4,775,246 | 10/1988 | Edelmann et al. | 380/23 |
| 4,780,828 | 10/1988 | Whisker | 364/464.14 |
| 4,831,555 | 5/1989 | Sansone et al. | 395/113 |
| 4,837,701 | 6/1989 | Sansone et al. | 364/464.14 |
| 4,853,864 | 8/1989 | Hart et al. | 364/464.13 |
| 4,873,645 | 10/1989 | Hunter et al. | 364/479.01 |
| 4,888,803 | 12/1989 | Pastor | 380/51 |
| 4,907,161 | 3/1990 | Sansone et al. | 364/464.13 |
| 5,257,196 | 10/1993 | Sansone | 364/464.13 |
| 5,390,351 | 2/1995 | DiGiulio et al. | 395/200.1 |
| 5,448,641 | 9/1995 | Pintsov et al. | 380/51 |
| 5,454,038 | 9/1995 | Cordery et al. | 380/23 |
| 5,586,036 | 12/1996 | Pintsov | 364/464.18 |
| 5,655,023 | 8/1997 | Cordery et al. | 380/51 |
| 5,675,650 | 10/1997 | Cordery et al. | 380/23 |

*Primary Examiner*—Edward R. Cosimano
*Attorney, Agent, or Firm*—Charles R. Malandra, Jr.; Melvin J. Scolnick

[57] ABSTRACT

A method for mail accounting and payment includes creating a mail batch including a plurality of mailpieces and creating a statement of mailing containing data relating to the mail batch. The statement of mailing is digitally signed to facilitate a subsequent verification of the integrity of the data in the statement of mailing. The digital signature is included as part of the statement of mailing. The statement of mailing is submitted to a transaction processing center. The transaction processing center initiates a funds transfer to a carrier delivery service for carrier delivery services payment for the batch of mail. The statement of mailing or other mailing data may be stored in a nonvolatile memory means. The nonvolatile memory means allows the statement of mailing to be stored therein and erased therefrom but not modified.

15 Claims, 9 Drawing Sheets

FIG. 3

| 3004 | 3014 | 3006 | 3016 | 3008 | 3018 | 3012 | 3020 | 3010 |
|---|---|---|---|---|---|---|---|---|
| MDF# 00001 | | MAILER ID 1234 | | VAULT ID 1234567 | | PIECE COUNT 0001 TO 01410 | | MAILER ACCOUNT 775532 |
| DATE 11 APRIL, 95 | | RATING TABLE 987654 | | SIGNATURE 01234567 | | ERROR CONTROL 001234321 | | 123 MAIN STREET ANYTOWN US 06484 [ACCEPTING PO] 301 |
| WEIGHT (OZ.) | | SIZE | | DISCOUNT | | POSTAGE | | NUMBER OF PIECES |
| 0.5 | | STANDARD | | FULL | | $0.32 | | 731 3022 |
| 1.0 | | SURCHARGE | | NON-PRESORT | | $0.55 | | 27 |
| 1.7 | | STANDARD | | PRE-BARCODED | | $0.57 | | 567 |
| 1.8 | | SURCHARGE | | PRESORT | | $0.75 | | 85 |
| 94.34 LB 3024 | | TOTALS 3002 | | | | $635.71 3026 | | 1410 3028 |

CLOSED LOOP TRANSACTION BASED MAIL ACCOUNTING AND PAYMENT SYSTEM WITH CARRIER PAYMENT THROUGH A THIRD PARTY INITIATED BY MAILING INFORMATION RELEASE

FIELD OF THE INVENTION

The present invention relates to mailing and accounting payment systems, and more particularly, to a closed loop transaction based mail accounting and payment system where payment to the carrier is through a third party and is initiated by information released by the mailer.

BACKGROUND OF THE INVENTION

Various methods have been developed for payment of carrier services. These payment methods include postage stamps which are individually applied to each mailpiece and metered imprints which are also individually applied to each mailpiece. Additionally other Systems have been developed such as permit mail where a carrier issues a permit allowing certain types of mailing and manifest systems wherein mail is manifested and delivered to a carrier service along with the manifest.

In a mail production environment, where large batches of mail are produced, each of the above payment methods involves compromises between ease of use and security for the payment of postage to the carrier service. Various permit and manifest mail systems, as well as related contract mail systems, have been implemented where no evidence of postage payment on individual mailpieces is provided. These systems often require complex and extensive acceptance procedures and associated documentation. These systems are very complex, time consuming and inaccurate for the carrier service in administering and accepting mail.

An improved system for controlled mail acceptance and evidencing has been developed where the plurality of mailpieces each having an encrypted indicia printed on the mailpiece. A mail documentation file is created containing the total weight of the mail batch, the total payment for the mail batch and the mailer identification, all of which are digitally signed to facilitate a subsequent verification of the integrity of the data. The digital signature maybe included as a part of the mail documentation file. The mail batch and mail documentation file are submitted to a carrier distribution system. The carrier processes the batch of mail and the mail documentation file as part of the carrier distribution process to determine the total weight of the batch of mail and to verify the weight the actual batch of mail in comparison to the total weight of the batch of mail as set forth in the mail documentation file. This system is disclosed in U.S. patent application Ser. No. 08/432,733 for CONTROLLED ACCEPTANCE MAIL PAYMENT AND EVIDENCING SYSTEM, filed May 2, 1995 for Robert A. Cordery, Linda V. Gravell, Leon A. Pintsov and Monroe A. Weiant, Jr. and assigned to Pitney Bowes Inc., which issued as U.S. Pat. No. 5,675,650 on Oct. 7, 1997. The entire disclosure of said U.S. patent application Ser. No. 08/432,733 is hereby incorporated by reference.

In this system, a vault is provided for the system which may be connected to a data center. The vault provides the issuance of digital tokens for imprinting on the mailpiece and stores the carrier service funds which are accounted for by the vault as digital tokens are issued. Additionally, a computer meter resetting function for the vault may be employed. This is a function where carrier service funds are refilled into the vault as carrier service payment evidencing is implemented through the printing of mailpieces thereby depleting stored carrier service funds in the vault. The controller or vault for the system may also be connected to a carrier service information center to provide logistics and payment information to the carrier service.

Other systems have been developed for preparing mailpieces, such as, the system shown in U.S. Pat. No. 5,454,038 for ELECTRONIC DATA INTERCHANGE POSTAGE EVIDENCING SYSTEM which involve the creation of mailing lists which include correct and incorrect recipient addressee information. The list is transmitted to a data center where the mailing list including addressee information is processed to provide digital tokens for each mailpiece which is then transmitted back to the mailer. Additionally, these systems may utilize the capability shown in U.S. Pat. No. 5,448,641 for POSTAL RATING SYSTEM WITH VERIFIABLE INTEGRITY where the rating for the various payments may be processed to provide information which is securely printed on the mailpiece to indicated the particular rating perimeter and rating table utilized in computing the payment for a particular mailpiece.

Other manifesting systems have also been proposed, for example, as set forth in U.S. Pat. No. 4,907,161 for BATCH MAILING SYSTEM; U.S. Pat. No. 4,837,701 for MAIL PROCESSING SYSTEM WITH MULTIPLE WORKSTATIONS; U.S. Pat. No. 4,853,864 for MAILING SYSTEM HAVING POSTAL FUNDS MANAGEMENT; and, U.S. Pat. No. 4,780,828 for MAILING SYSTEM WITH RANDOM SAMPLING OF POSTAGE.

SUMMARY OF THE INVENTION

It is an object of the present invention to provide a mailing system where the mailer has enhanced flexibility controlling the payment to the carrier.

It is a further object of the present invention to provide a closed loop transaction based mail and accounting payment system for enhancing the integrity and timeliness of the mailing process.

It is yet a further object of the present invention to enable the mailer to initiate payment for mail to be delivered to a carrier through information released to a third party.

It is still another objective of the present invention to eliminate the requirement for postage reimbursement by the carrier for mailpieces which are improperly prepared during mail preparation.

A method for mail accounting and payment embodying the present invention includes creating a mail batch including a plurality of mailpieces and creating a statement of mailing containing data relating to the mail batch. The statement of mailing is digitally signed to facilitate a subsequent verification of the integrity of the data in the statement of mailing. The digital signature is included as part of the statement of mailing. The statement of mailing is submitted to a transaction processing center. The transaction processing center initiates a funds transfer to a carrier delivery service for carrier delivery services payment for the batch of mail.

In accordance with another aspect of the present invention the statement of mailing or other mailing data may be stored in a nonvolatile memory means. The nonvolatile memory means allows the statement of mailing to be stored therein and erased therefrom but not modified.

BRIEF DESCRIPTION OF THE DRAWINGS

Reference is now made to the following figures wherein like reference numerals designate similar elements in the various figures and in which:

FIG. 3 is a statement of mail created in accordance with the present invention based on the system shown in FIG. 1;

DETAILED DESCRIPTION OF THE PREFERRED EMBODIMENT

Figure 1:
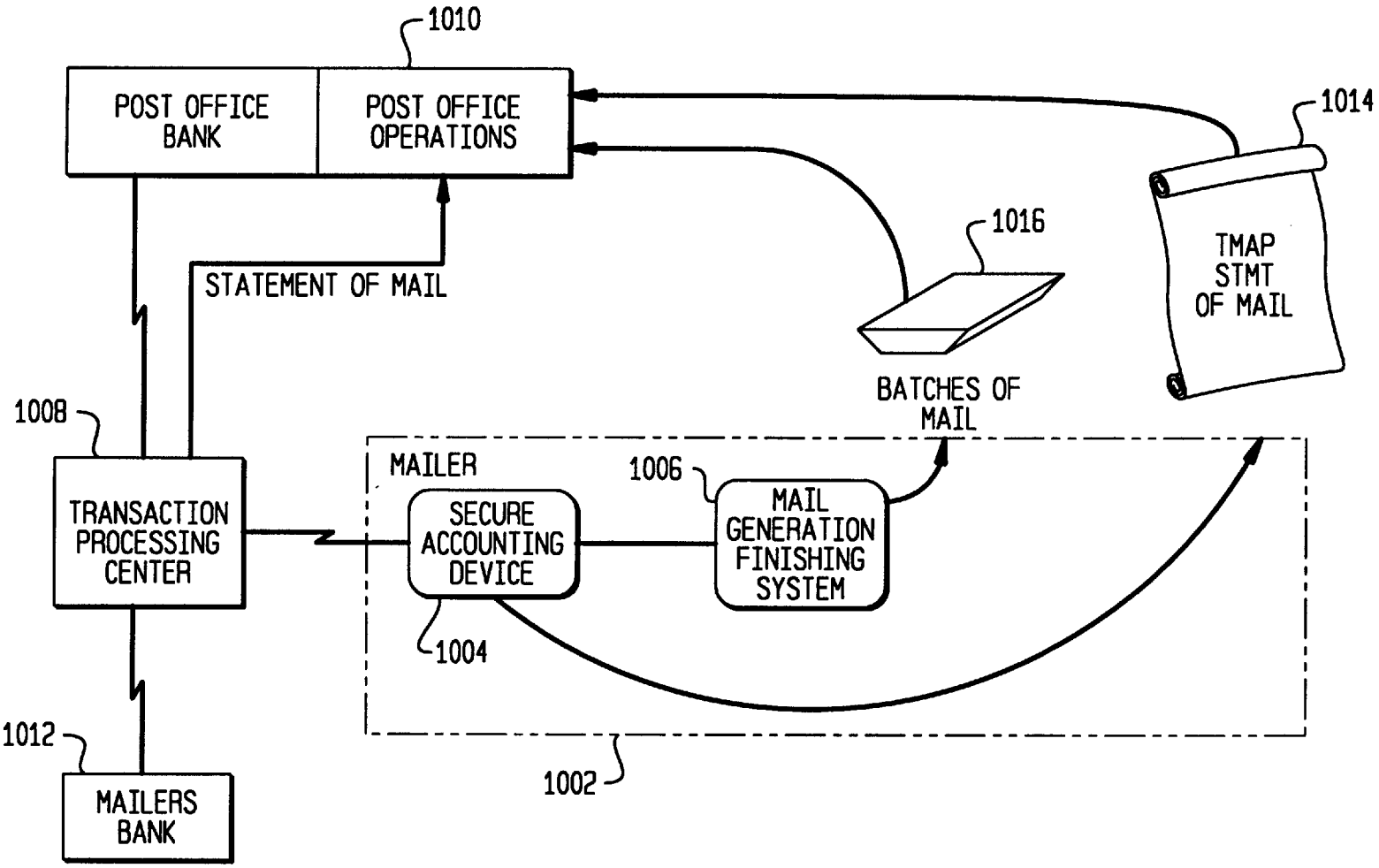
FIG. 1 is a diagrammatic representation of a closed loop transaction based mail accounting and payment system embodying the present invention with carrier payment through a third party initiated by the release by mailer of mailing information.

Reference is now made to FIG. 1. A mailer facility 1002 includes a secure accounting device 1004 and a mail generation and finishing system 1006. Mail generation and finishing system 1006 may be any of a large number of mailing systems which creates and processes mailpieces to prepare them for delivery to a carrier service. The mail generation and finishing system 1006 is coupled to a secure accounting device 1004 which will be explained in greater detail in connection with FIGS. 4, 8 and 9. The secure accounting device 1004, for each mailpiece to be produced by the mail generation and finishing system 1006, issues a digital token to be imprinted on the mailpiece. The digital token which is encrypted data that authenticates the value or other information imprinted on the mailpiece. The digital token may include the rating information and the payment value associated with a particular mailpiece. Examples of systems for generating and using digital tokens are described in U.S. Pat. No. 4,757,537 for SYSTEM FOR DETECTING UNACCOUNTED FOR PRINTING IN A VALUE PRINTING SYSTEM; U.S. Pat. No. 4,831,555 for UNSECURED POSTAGE APPLYING SYSTEM; and, U.S. Pat. No. 4,775,246 for SYSTEM FOR DETECTING UNACCOUNTED FOR PRINTING IN A VALUE PRINTING SYSTEM. Because the digital token incorporates encrypted data including postage value, altering the printed postage revenue on the postage revenue block is detectable by standard verification procedures. Additionally, the secure accounting device 1004 counts for each digital token issued to the mail generation and finishing system for imprinting on a mailpiece.

The secure accounting device 1004 further stores the statement of mailing associated with a batch of mail being prepared by the mail generation and finishing system 1006. This statement of mailing is electronically communicated to a remote transaction processing center 1008. This initiates a further transmission of the statement of mailing and authorization for payment to a carrier service 1010. The transmission of the statement of mailing is the release of mailing information by the mailer to a third party, here the transaction processing center, to authorize payment by the processing center to the carrier. The payment may be by the transaction processing center 1008 accessing a mailer account at a financial institution 1012 for either direct payment by the financial institution to the carrier service or by being passed through the transaction processing center and then to the carrier service or carrier services financial institution, as for example, a post office bank as shown in FIG. 1. To provide a redundancy in the system and for logistics planning, the statement of mail may additionally be transmitted directly by the mailer 1002 either in electronic and/or in printed form (such as printed statement of mail 1014) to the carrier service 1010. The statement of mail transmission to the carrier service provides a verification of the independent verification of the transaction occurring via the transaction processing center 1008.

After the statement of mail has been electronically transmitted by the mailer secure accounting device 1004 to the transaction processing center 1008, the batch of mail associated with the transaction 1016 is physically transmitted to the carrier service 1010. The carrier service then may perform the various control acceptance procedures associated with the carrier service internal processes.

As can be seen, the system provides a closed loop transaction in that upon receipt of the statement of mail by the carrier 1010 and processing of the batch of mail 1016, the carrier service communicates either directly or via the transaction processing center 1008 to the mailer 1002 indicating acceptance and processing of the batch of mail 1016.

As a measure to provide enhanced security, the secure accounting device 1004 will not release the statement of mailing for utilization by the mail processing system until it is initially transmitted electronically to the transaction processing center 1008 and approved by the transaction processing center based on funds availability in the mailer's account 1012.

It should be recognized that the process of postage payment is entirely controlled by the mailer 1002. After the mail generation and finishing system has completed preparation of the batch of mail 1016, the mailer, at a time of the mailer's choosing, initiates a communication between the secure accounting device 1004 and the transaction processing center 1008. This communication involves transmission of information related to the statement of mail to be prepared once authorization is received from the transaction processing center concerning funds availability. At the time the transaction processing center 1008 provides the authorization to the secure accounting device 1004, the transaction processing center 1008 also transfers appropriate funds to the carrier service 1010. Unlike secured accounting devices that store carrier payment value, such as electronic postage meters and other such postage payment devices that store funds, the secure accounting device 1004 does not store prepaid carrier value for use in printing evidence of payment for carrier services.

It should be recognized that the communications system facilitates a bi-directional communications. This communication is particularly useful for providing confirmation to the mailer 1002 as to the provision of certain requested services. Examples of such services are registered or certified mail services for particular mailpieces, insurance payment for particular mail, special delivery for particular mailpieces. All of these and other forms of special services, can be confirmed by the carrier service 1010 through the transaction processing center 1008 to the secure accounting device 1004 to securely store and provide the information to the mailer. Since the communications and storage of the information is secured, the receipt of the information provides proof of delivery, or deposit and/or other services.

It should be noted that rating tables and rating information can be communicated from the carrier service 1010 through the transaction processing center 1008 to the secure accounting device 1004. In this manner, the secure accounting device 1004 may be continually updated with the most current and appropriate rating tables for the various mailing activities desired to be implemented by the mailer 1002. It provides an opportunity for the carrier service 1010 to dynamically update the various rating tables and to provide temporary discounts for various services such as mailing occurring at a particular time, to a particular facility or in a particular manner. This can be utilized to optimize traffic through the carrier system through various rating incentives.

Figure 2:
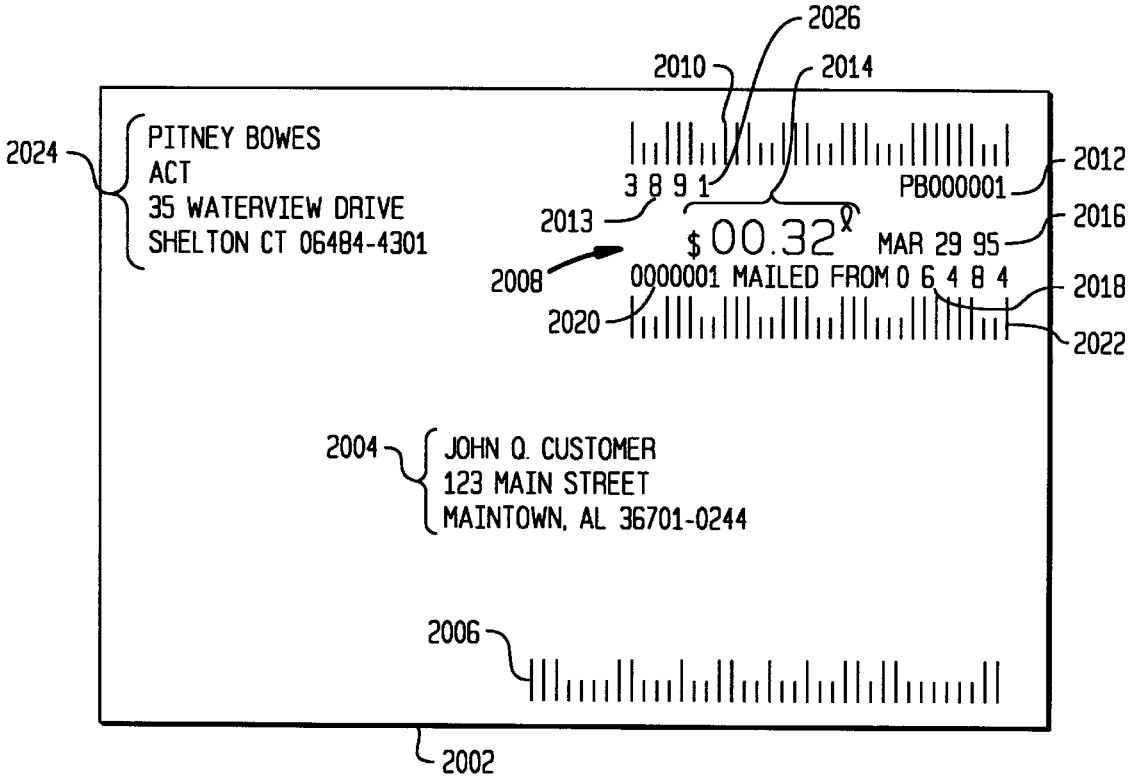
FIG. 2 is a mailpiece created in accordance with the present invention based on the system shown in FIG. 1.

Reference is now made to FIG. 2. Mailpiece 2002 is of a type which may be produced by the system shown in FIG. 1. The mailpiece contains addressee information generally shown at 2004, a postal delivery bar code 2006 and an encrypted indicia shown generally at 2008. The encrypted indicia including the digital tokens can be formatted in many ways depending upon the requirements of the particular carrier service involved. Additionally, different information may be included or omitted from the encrypted indicia depending upon the needs and requirements of the carrier service. The encrypted indicia 2008 includes a vault identification number bar code 2010 shown in alphanumeric representation as PB0000001 at 2012. The indicia 2008 further includes an imprinted number 389 shown at 2013. At the first digit "3" is an error correcting digit and the next two digits "8" and "9" are vendor and carrier service digital tokens, respectively. One suitable system for verification using two encrypted tokens is disclosed in U.S. Pat. No. 5,390,251 for MAIL PROCESSING SYSTEM INCLUDING A CARRIER DATA CENTER VERIFICATION FOR MAILPIECES. These digital tokens enable the carrier service or the vendor to separately authenticate validity of the encrypted indicia 2008. Moreover, the digital tokens can be pre-computed. Reference is made to pending U.S. patent application Ser. No. 08/242,564 filed May 13, 1994 for ADVANCED POSTAGE PAYMENT SYSTEM EMPLOYING PRE-COMPUTED DIGITAL TOKENS WITH ENHANCED SECURITY, assigned to Pitney Bowes Inc., which issued as U.S. Pat. No. 5,655,023 on Aug. 5, 1997. The disclosure of which is hereby incorporated by reference.

The encrypted indicia further includes the imprint of the postage amount for the mailpiece at 2014, the date at 2016, the originating postal code at 2018, and the sequence piece count for the secure accounting device 1004 at 2020. A bar code at 2022 is a machine readable representation of piece count 2020. A return address which may also include the originating postal code is shown at 2024.

Additionally, included on the mailpiece is a statement of mailing serial number 2026. This statement of mailing serial number, here shown, for example, as a single digit "1", uniquely identifies the statement of mailing which accounts for a given mailpiece on a given day. This provides a unique verifiable linkage between the physical mailpiece in a batch mail and the associated statement of mail for the batch. This verification, as will be apparent when the statement of mailing is explained is bi-directional. This means that when a mailpiece is inspected it can be uniquely linked to a statement of mailing which has been transmitted to the carrier service 1010. Correspondingly, when a statement of mailing is inspected, it can be uniquely associated with a particular mailpiece.

It should be recognized that the information described above in connection with the mailpiece is the information desirably utilized to accomplish the authentication and verification of payment for mail submitted to the carrier service. However, additional information maybe beneficially included on the mailpiece such as the date of last inspection of the secure accounting device a request for special services for a given mailpiece, such as express mail, a track and trace and any delivery instructions. This may be imprinted on the mailpiece as a separate imprint or as a machine readable bar code which may be encrypted and may be digitally signed.

It should be recognized that the physical formatting of the information printed on the mailpiece is a matter of choice and may be either imprinted in the address block, revenue block or both areas.

Reference is now made to FIG. 3. A printed mail documentation file is shown at 3002. The file is submitted to the carrier service prior to the physical submission of the batch of mail. The timing of the submission of the mail documentation file and the physical mail is important and plays a critical role in the acceptance procedure. The file 3002 is provided, as previously explained by the transaction processing center 1008 electronically to the carrier service 1010. Additionally, as also previously noted the file 3002 can be additionally provided by the mailer to the carrier service 1010 either as a printed document and/or electronically or on a storage medium.

The mail documentation file, which is the statement of mail, includes the mail documentation file serial number 3004, a mailer identification at 3006, a secure accounting device identification at 3008 and a mailer account at 3010. Each mailer may have several different accounts which are accessed by the transaction processing center 1008 for use in different applications and each account may have several different secure accounting devices such as 1004 associated with it. A piece count for the mail run is also provided at 3012. In the particular run documented by the mail documentation file 3002, 1,410 mail pieces were produced for submission as the batch. Also provided as part of the mail documentation file is the date of submission at 3014, the identification of the rating table employed at 3016. It should be noted that the rating table identification may be a truncated encrypted hash code of the rating table employed in a manner described in the above noted patent U.S. Pat. No. 5,448,641 for POSTAL RATING SYSTEM WITH VERIFIABLE INTEGRITY.

The address and postal code of the accepting post office is provided at 3017.

A digital signature of the entire mail documentation file, is provided at 3018 and an error control code at 3020 to facilitate error detection and correction when machine reading the mail documentation file. This control code is particularly useful if the mail documentation file is printed and physically presented to the postal service or carrier service 1010.

The mail documentation file further contains information for groups of mailpieces which are similar in weight, size, discount and carrier payment or postage. For example, on line 1 at 3022, 731 pieces with postage value of 32 cents, the full postage rate of the standard size U.S. mailpiece and with the actual weight of 5/10 of an ounce are listed. Similarly, in the following entries various groups of mailpieces having similar weight, size, discount and postage are listed. The various totals, such as the total weight of the mailpieces in the batch are provided at 3024 along with the total postage at 3026 and the total number of mailpieces at 3028.

It should be expressly recognized that the organization and content of the statement of mailing 3002 is a matter of preference depending upon the needs of the mailer, carrier and transaction processing center.

Figure 4:
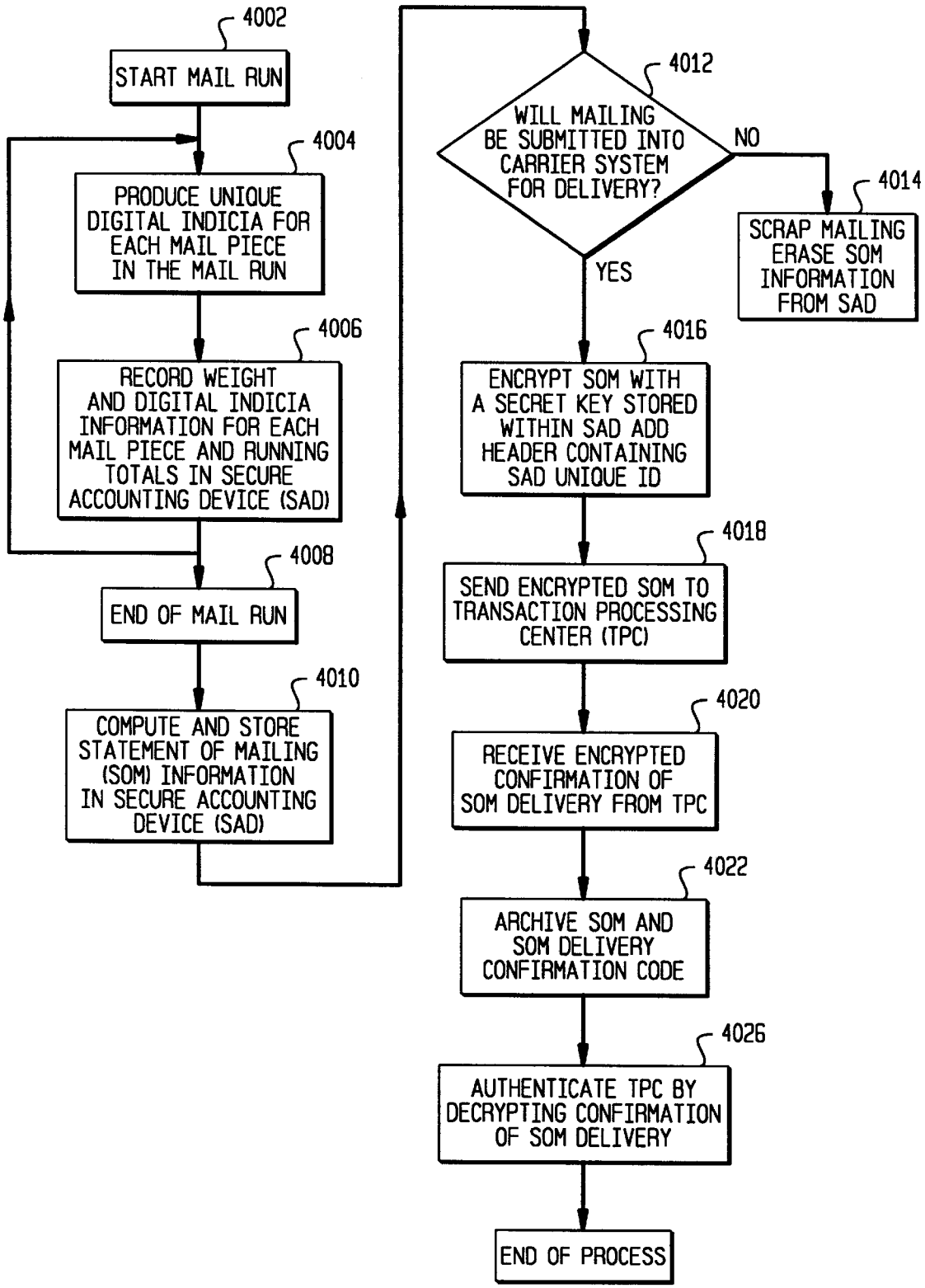
FIG. 4 is a flow chart of the mail generation process at a mailer facility including communications to remote transaction processing center.

Reference is now made to FIG. 4. A mailer commences a mail run at 4002. A unique digital indicia is produced for each mailpiece in the mail run at 4004. The digital indicia may include the digital tokens (which may be printed on other portions of a mailpiece and various graphic and data elements). The record is made of the weight and digital indicia information for each mailpiece and running totals in the secure accounting device at 4006. This process continues until the last mailpiece in the mail run has been processed and the end of the mail run reached at 4008.

A statement of mailing is then computed and stored in the secure accounting device at 4010. It should be recognized that the statement of mailing is now stored in the secure accounting device 1004 shown in FIG. 1. Thus, the statement of mailing may not be tampered with or modified since it is in the secure accounting device 1004 and thus protected. A determination is then made whether the mail will be submitted into the carrier system for delivery at 4012. This determination is made by the mailer who is fully in control as to when the mailing will be submitted to the carrier system for delivery. If the mailing is not to be delivered to the carrier service, the mailer may elect to scrap the mailing and to erase the statement of mailing information from the secure accounting device at 4014. It should be expressly noted that the mailer has the option to either retain the data of the statement of mailing in the secure accounting device or to erase the data of the statement of mailing in the secure accounting device. However, the mailer is not enabled to modify or change the statement of mailing stored in the secure accounting device. Alternatively, if desired, the secure accounting device may store non-used statements of mailing for a predetermined period of time prior to being enabled for erasure or deletion from the secure accounting device memory.

When the mailing will be delivered to the carrier service, the statement of mail is encrypted with a secret key stored within the secure accounting device 1004 and a header is added containing the secure accounting device unique identification at 4016. The encrypted statement of mailing is then sent to the transaction processing center at 4018 and the mailer receives an encrypted confirmation of the statement of mailing delivery from the transaction processing center at 4020.

The statement of mailing delivered to the transaction processing center and statement of mailing delivery confirmation code received from the transaction processing center are archived (for example in the secure accounting device 1004) at 4022. The confirmation of statement of mailing delivery is decrypted to authenticate the transaction processing center at 4024. This ensures that the confirmation of statement of mailing has been received from the appropriate transaction processing center. At that time the process is completed at 4026 the mail may be physically delivered to the carrier service for physical processing.

It should be noted that if the decryption of the confirmation of delivery were at any other point in the process where appropriate information is not received or is not authenticated, the secure accounting device 1004 may alert the mailer and exception processing is initiated to deal with the specific matter. Exception processing may involve the re-initiation of the process which failed to attempt to achieve a successful completion such as authentication of the transaction processing center. Upon appropriate authentication, for example, the process would continue. However, if this could not be achieved, specific procedures as predetermined by the carrier service would be implemented and the mail would be not processed in accordance with the present procedure.

Figure 5:
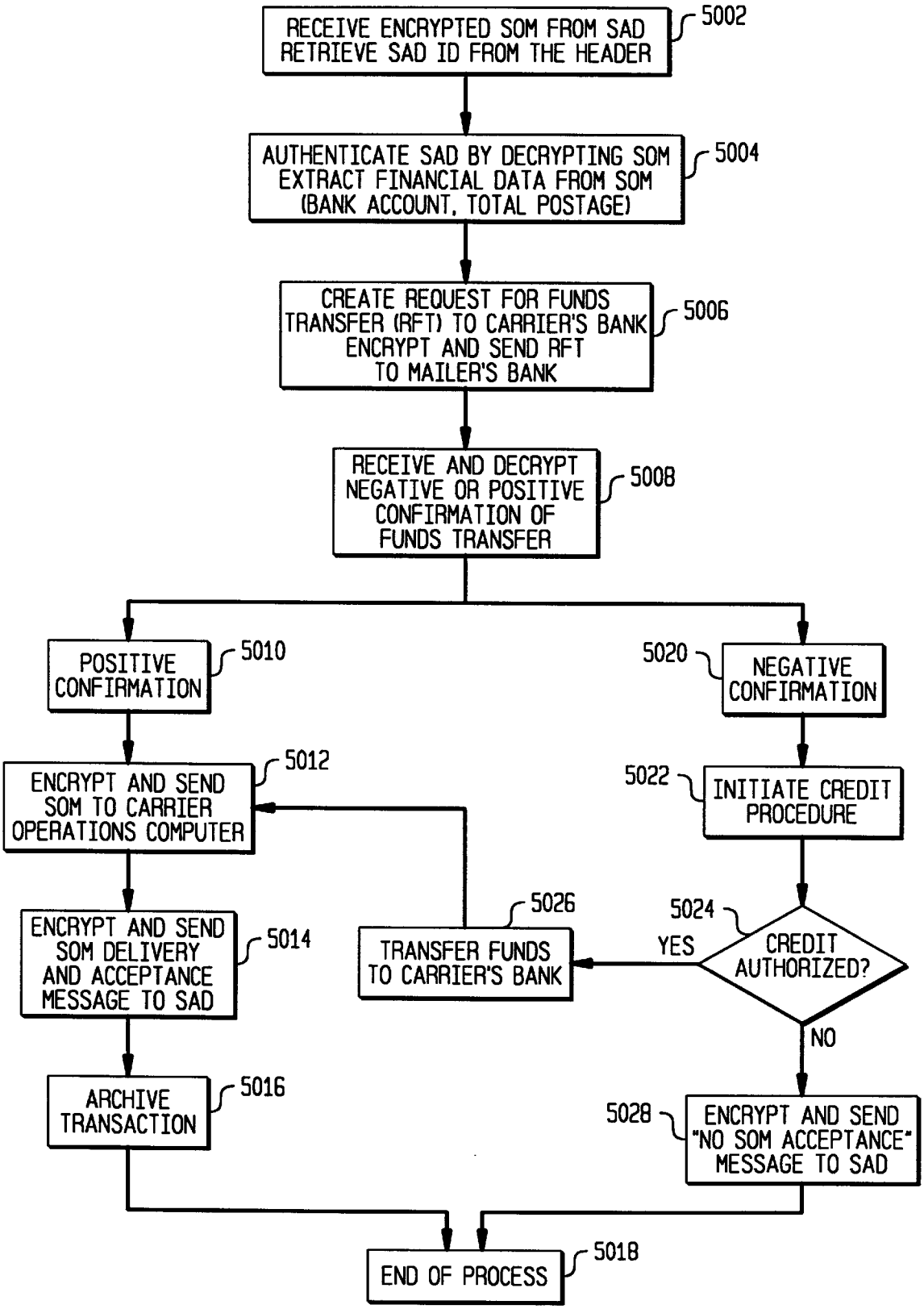
FIG. 5 is a flow chart of a remote transaction processing center which is in communication with the mailer, a financial institution, and a carrier service.

Reference is now made to FIG. 5. The statement of mailing from the secure accounting device is received at the transaction processing center at 5002. Additionally, at 5002 the secure accounting device identification is retrieved from the header of the received encrypted statement of mail. The statement of mailing is decrypted to authenticate the secure accounting device and to extract financial data from the statement of mailing at 5004. The extracted information may include information such as the mailer's bank account, the total postage and other information, as previously noted relative to the mail batch.

The decryption process is actuated by using the header from the encrypted statement of mailing to retrieve the mailer's relevant encryption (or decryption) key and utilizing that key to decrypt the statement of mailing for further processing.

It should be recognized that many different forms of encryption such as secret key encryption systems and/or public and private key encryption systems may be utilized with the present invention.

A request for funds transfer is created, encrypted and sent as a request for funds transfer (RFT) to the mailer's bank at 5006. The transfer of funds is from the mailer's bank to the carrier's bank and is being initiated by mailing information released by the mailer through the sending of the encrypted statement of mailing to the transaction processing center.

The transaction processing center receives and decrypts negative or positive confirmation from the mailer's bank of the funds transfer having been effectuated at 5008. If desired, a further confirmation may be requested from and received from the carrier's bank confirming the receipt by the carrier's bank of the transferred funds. If the mailers bank provides a positive confirmation at 5010, the transaction processing center encrypts and sends the statement of mailing to the carrier's operations computer at 5012. Additionally, the transaction processing center encrypts and sends the statement of mailing, delivery and acceptance message to the mailer's secure accounting device 1004 at 5014. The transaction is thereafter archived at the transaction processing center at 5016 for later retrieval if necessary. This ends the processing at the mail processing center for the batch of mail at 5018.

If a negative confirmation is received from the mailer's bank regarding the transfer of funds at 5020, a credit procedure is initiated at 5022 and a determination made at 5024 whether credit has been authorized. If credit is authorized the transfer of funds to the carrier's bank is initiated at 5026 and the system loops back to block 5012. The credit authorization can be by way of the transaction processing center transferring funds on behalf of the mailer to the carrier's bank or by way of a credit card authorization or other financial service authorization on behalf of the mailer.

If credit authorization is not achieved at 5024 a "No statement of mailing acceptance" message is encrypted and sent to the secure accounting device 1004 at 5028. The process again ends at 5018.

Figure 6:
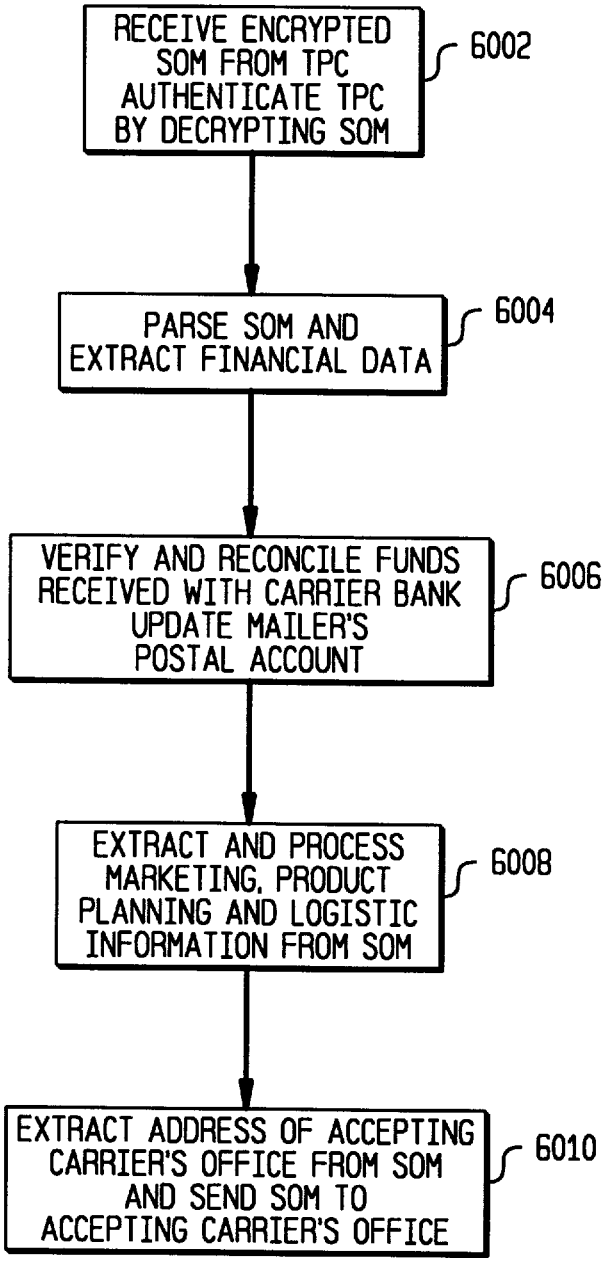
FIG. 6 is a flowchart of the carrier service processing of a statement of mail in accordance with the present invention.

Reference is now made to FIG. 6. Carrier service receives the encrypted statement of mailing from the transaction processing center at 6002 and authenticates the transaction processing center by decrypting the statement of mailing. The statement of mailing is processed and parsed and financial and other data is extracted from the statement of mailing at 6004. Funds received by the carrier's bank are verified and reconciled at 6006 and the mailer's postal account is updated.

The other data is extracted and processed from the statement of mailing at 6008. This data may include marketing, product planning and logistics information data relevant to the carrier service. The address of the accepting carrier service office, that is the office which will physically receive the mail, is extracted from the statement of mailing and the statement of mailing is sent to the accepting carrier's office at 6010. This information is used in operations at the accepting carrier's office and for planning purposes.

Figure 7:
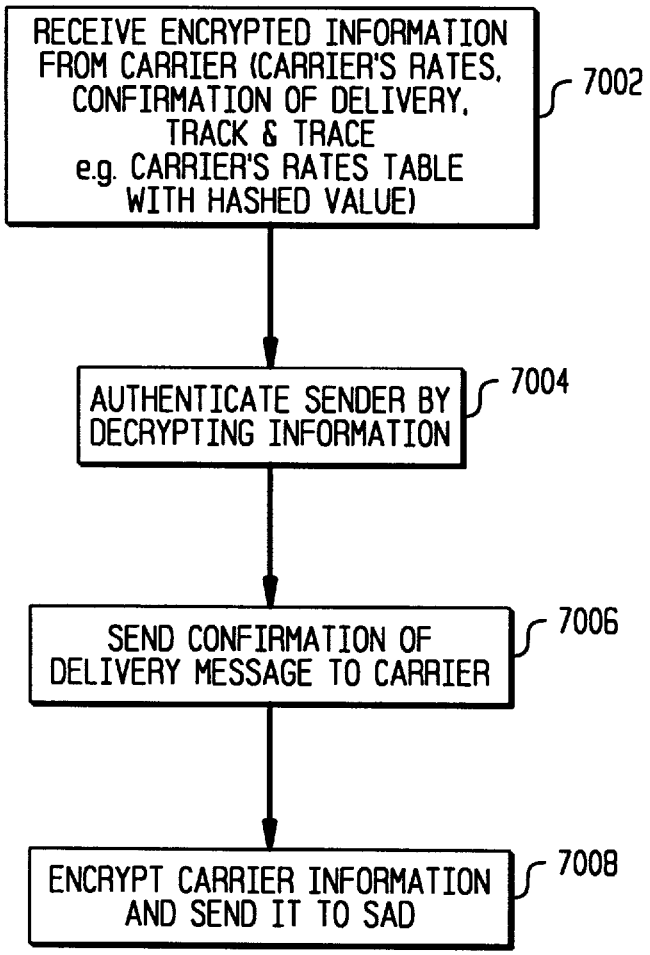
FIG. 7 is a flowchart of the transaction processing center communicating information from a carrier service to a mailer.

Reference is now made to FIG. 7. As previously noted various information may beneficially flow from the carrier service to the mailer through the transaction processing center. The transaction processing center receives encrypted information from the carrier's service such as postal rates, confirmation of delivering, track and trace, postal rating table with hashed values, and other useful information at 7002. The carrier service, the sender, is authenticated by the transaction processing center decrypting the received information at 7004. A confirmation of delivery message is sent to the carrier service office at 7006. Thereafter the carrier's encrypted information is sent by the transaction processing center to the mailer's secure accounting device at 7008.

It should be recognized that the secure accounting device when receiving the encrypted carrier's information would authenticate the source of the information, decrypt the message and take appropriate action such as updating a postal rate table and providing a confirmation of receipt and update to the transaction processing center. Similar type of procedures would occur in terms of track and trace, confirmation of delivery, etc. depending upon the particular service and type of information flowing from the carrier service through the transaction processing center to the mailer. This enables the closed loop transaction based mail accounting and payment.

Figure 8:
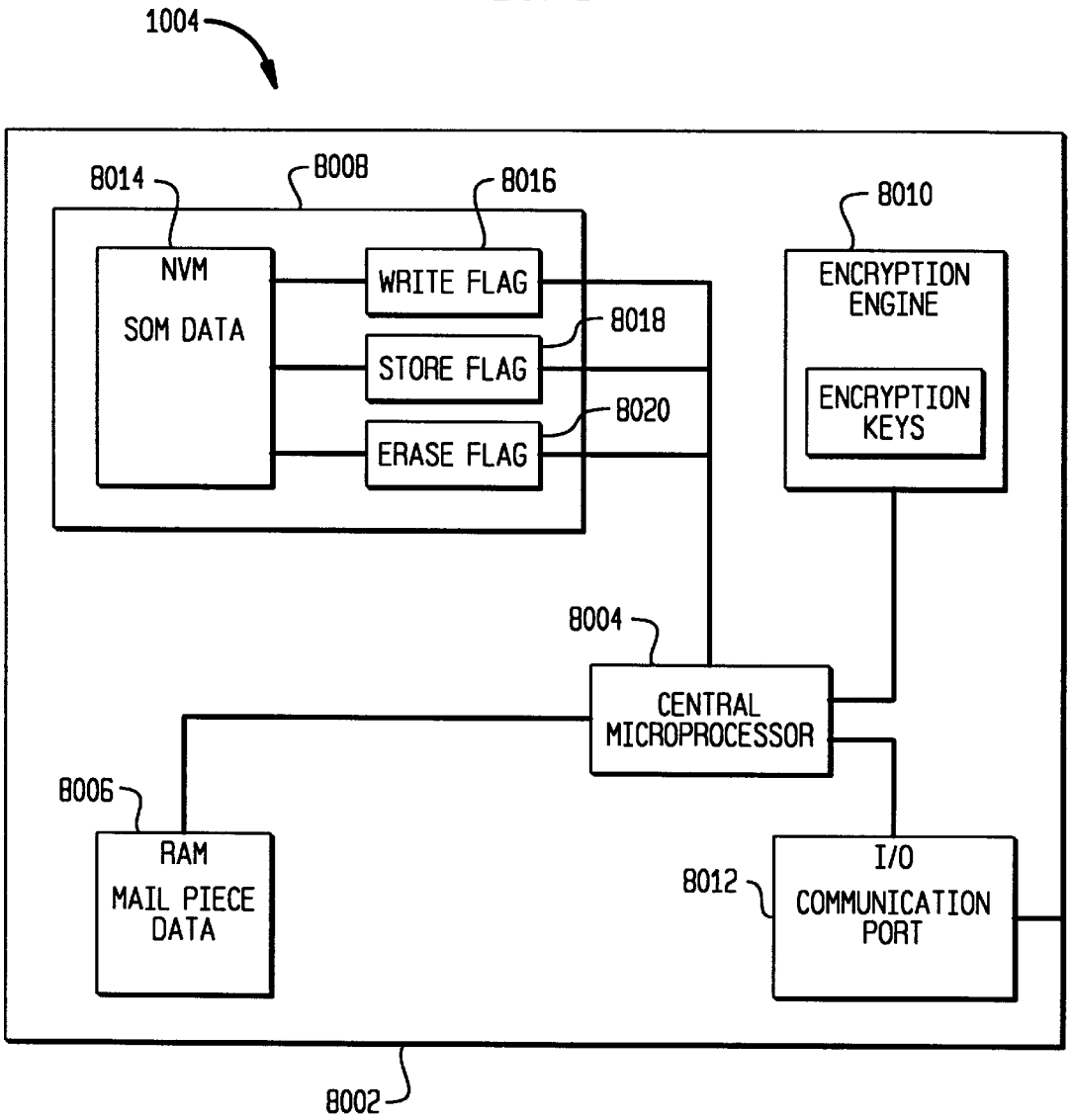
FIG. 8 is a diagrammatic representation of a secure accounting device suitable for use in the system shown in FIG. 1 and incorporating aspects of the present invention; and, FIG. 9 is a flow chart of the operation of secure accounting device shown in FIG. 8.

Reference is now made to FIG. 8. The secure accounting device 1004 includes a tamper resistant housing 8002. Within the tamper resistant housing is a central microprocessor 8004 for controlling the operation of the secure accounting device 1004. The microprocessor and various related microprocessor and/or microcontroller devices and systems are suitable for utilization as part of the secure accounting device 1004. A random access memory 8006 wherein mailpiece data may be stored is connected to the central microprocessor 8004. Additionally connected to the central microprocessor 8004 are a non-volatile memory subsystem 8008 and an encryption engine subsystem 8010. Communications to the secure accounting device are by way of an input/output communications port 8012. The non-volatile memory subsystem 8008 includes a non-volatile memory 8014 which is controlled by the microprocessor via three operational flags. These flags may be implemented either in separate hardware structure in areas within the non-volatile memory device 8014. A first flag, a write flag 8016 is utilized to enable writing into the non-volatile memory 8014 via the central microprocessor 8004. A store flag 8018 is actuated after a writing operation has been completed. The actuation of the store flag precludes later modification of data written into the non-volatile memory 8014. Accordingly, data may be written into non-volatile memory 8014 via the write flag 8016 and be changed and modified. However, once the store flag 8018 is set, modification of this data is precluded. Notwithstanding the fact that the data may not be modified once the store flag 8018 is set, the data, in its entirety may be erased by actuation of an erase flag 8020. Thus, data may be written into the memory and modified; however, once the store flag is set it may not be modified but only erased via actuation of the erased flag 8020.

The encryption engine module 8010 is employed to encrypt communications and decrypt communications that are transmitted from or received by the secure accounting device 1004 via the I/O communications port 8012. The encryption engine 8010 is also utilized to generate the digital signature for the statement of mailing. That is, the statement of mailing, is run through a hash code function and the resultant output is then encrypted using protected encryption keys.

Figure 9:
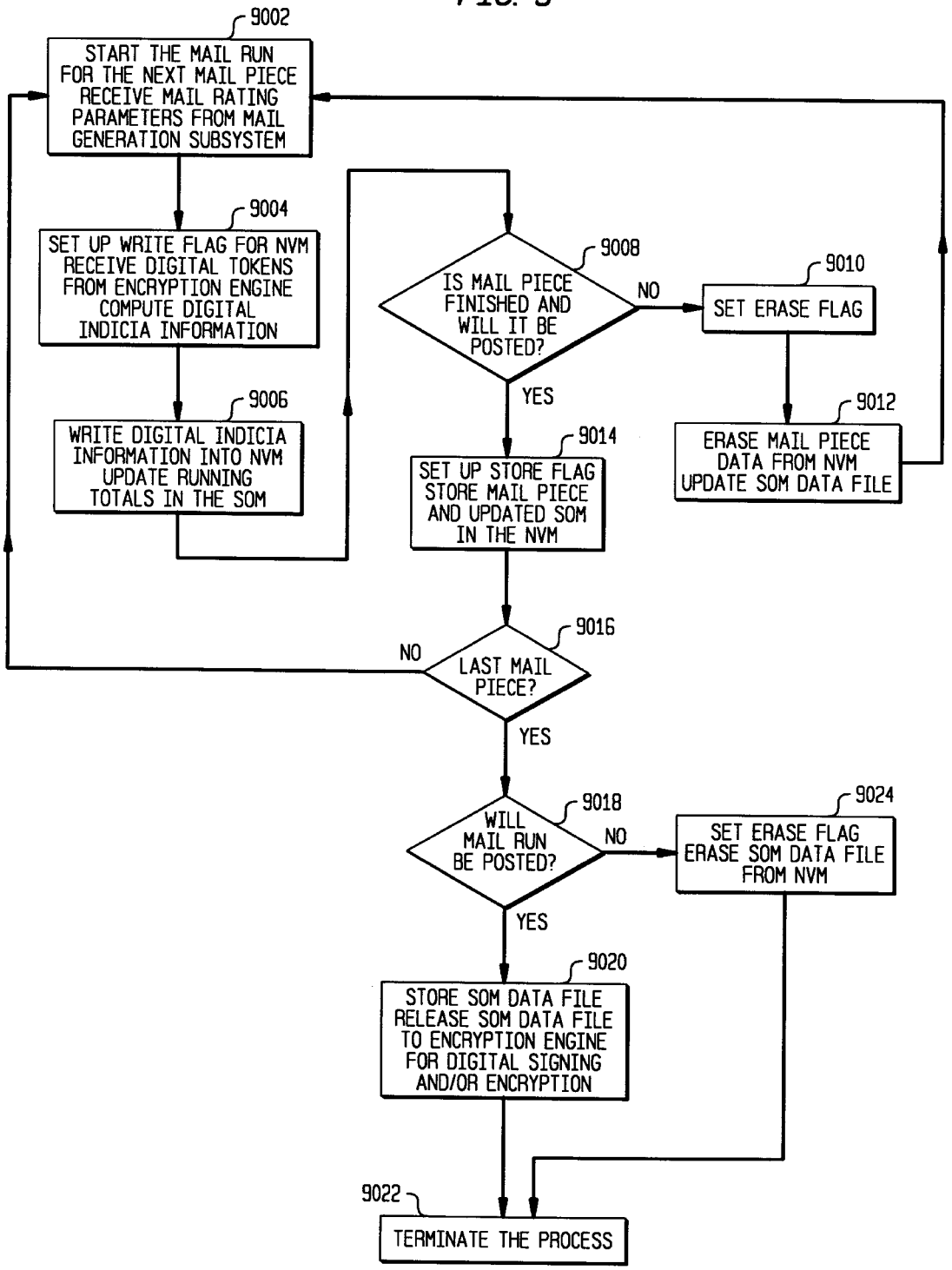

Reference is now made to FIG. 9. The secure accounting device 1004 operates as follows. At the start of a mail run the mailpiece rating parameters from the mail generation system are received for the next mailpiece to be processed at 9002. At 9004 the write flag for the non-volatile memory is set up to enable writing and information concerning the digital indicia is obtained including receiving the digital tokens from the encryption engine and other necessary information to organize and format the digital indicia to be imprinted on the mailpiece. The digital indicia information is written into the non-volatile memory 8014 and the running totals for the statement of mailing are updated in the non-volatile memory 8014 at 9006. A determination is made at 9008 if the mailpiece is finished and if it will be posted, that is, physically deposited with the carrier service for processing. If it is not to be posted the erase flag is set at 9010 and the mailpiece data from the non-volatile memory associated with updating the statement of mail mailing data file is erased either through an erase procedure or by the next write procedure into that memory location dealing with the next mailpiece at 9012.

If the mailpiece is finished and will be posted the store flag 8018 is set at 9014 and the mailpiece data and updated statement of mailing data are stored in the non-volatile memory in a manner where it may no longer be modified. A determination is then made if the mailpiece is the last mailpiece in the batch at 9016. If not, the process loops back to block 9002 and continues. If, however, the mailpiece is the last mailpiece in the batch, a further determination is made at 9018 whether the entire mail batch will be posted. If the mail batch will be posted the statement of mailing data file is stored and also sent to the encryption engine 8010 for digital signing and/or encryption at 9020. This terminates the process at 9022.

If the mail run batch will not be posted as determined at 9018, the erase flag is set at 9024 and the entire statement of mailing data file is erased or deleted from the non-volatile memory. It should be noted that the statement of mailing can be left in the non-volatile memory but rendered inactive if historical information is desired to be kept by either the mailer or the carrier service. This inactive file may be retained for a period of time depending upon the needs and requirements of the carrier service and the mailer. In any event, the process again terminates at 9022.

As can be seen from the foregoing the closed loop transaction based mail accounting and payment system with carrier payment through a third party initiated by mailing release of information has numerous benefits to the carrier service and to the mailer. The carrier service receives benefits in that payment for mailing is received prior to mail introduction. Additionally, an electronic version of the statement of mailing is received prior to the mailing. This allows the carrier service to do logistics planning. Assurance is provided to the carrier service that mail has been paid for and processed through an authorized system and provides assurance of funds payment to the carrier service. The transaction processing center acts as a third party available for dispute resolution. The system does not require procedures and cash disbursement for spoiled metered mail. Such a procedure can be time consuming and expensive. Furthermore, the carrier service is able to utilize an information based infrastructure which is available to automate mail acceptance processing and mail information is auditable and can be utilized for downstream revenue verification. Moreover, the carrier service may utilize value added information for special services to be provided to mailers and others, for example, track and trace, can be acquired prior to mail introduction.

The mailer also receives numerous benefits from the system. The system enables just in time payment for the mail. Importantly, there is no need to store carrier service funds in a meter vault at the mailers facility or any other facility. The mailer has no spoiled envelopes with indices which require postage reimbursement by the carrier service. The mailer has a more streamlined efficient mail acceptance process due to information and payment exchanged in advance with the carrier service. The system ensures the confidentiality of mailer information exchanged with the carrier service. The mailer need not be concerned with loss of funds or the need to reconcile with the carrier service in the event of a meter vault failure. This is because there are no funds stored in the secure accounting device. The mailer is provided with full control of the value and preparation of the mail through the mail preparation process. Moreover, the value and make up of the mail is not finalized until the statement of mail and requests the carrier service payment is sent to the transaction processing center by the mailer. The mailer eliminates loss of carrier service payment or postage associated with mailings that are scrapped for any number of reasons which is due to misprints or machine failures. The system enables the transaction processing center to provide a variety of credit arrangements. The transaction processing center provides the ability for the mailer to manage and track multiple payments and transactions operating business entities under a single master account with multiple subaccounts. This allows a single payment with multiple accounting. Furthermore, the mailer may employ high speed processing and is not subject to the restrictions of various mechanical payment methods such as rotary meters or other mechanical printing which would slow the mail processing.

While the present invention has been disclosed and described with reference to the disclosed embodiments thereof, it will be apparent, as noted above, that variations and modifications may be made. For example, the secure accounting device may be enabled for direct communications with the carrier service, as another example, the secure accounting device, can be a stand alone device with its own communications, keyboard and display or a secure module coupled to or a part of a personal computer. It is, thus, intended in the following claims to cover each variation and modification that fall within the true spirit and scope of the present invention.

What is claimed is:

1. A method for mail accounting and payment, comprising the steps of:

creating a mail batch including a plurality of mailpieces;

creating a statement of mailing containing data relating to said mail batch;

digitally signing said statement of mailing, said digital signature included as part of said statement of mailing;

submitting said statement of mailing to a transaction processing center;

said transaction processing center authenticating the signed statement of mailing and then initiating a funds transfer to a carrier delivery service for carrier delivery services payment for said batch of mail; and delivery the mail batch to the carrier delivery service upon confirmation by the transaction processing center.

2. A method for mail accounting and payment as defined in claim 1 further including the step of said transaction processing center submitting a confirmation of acceptance or non acceptance of said statement of mailing to the submitter of said statement of mailing.

3. A method for mail accounting and payment as defined in claim 2 wherein said submitting of said confirmation of acceptance or nonacceptance of said statement of mailing to the submitter of said statement of mailing occurs after said transaction processing center has created a request for fund s transfer from said mailer's financial institution to said carrrier's financial institution and has received a confirmation of funds transfer.

4. A method for mail accounting and payment as defined in claim 3 wherein each mail piece of said plurality of mail pieces has an encrypted indicia printed thereon.

5. A method for mail accounting and payment as defined in claim 4 wherein said steps of submitting are electronic communications between said submitter of said statement of mailing, transaction processing center and said carrier service.

6. A method for mail accounting and payment as defined in claim 5 further including the step of the submitter of said statement of mailing additionally submitting said statement of mailing to said carrier service.

7. A method for mail accounting and payment as defined in claim 6 further including the step of said carrier service submitting information to said transaction processing center and said transaction processing center submitting said information to said submitter of said statement of mailing.

8. A method for mail accounting and payment, comprising the steps of:

creating a batch of mail including a plurality of mailpieces;

creating a statement of mailing containing data relating to said mail batch; and, storing said statement of mailing in a nonvolatile memory means, said nonvolatile memory means allowing said statement of mailing to be stored therein and erased therefrom but not modified.

9. A method for mail accounting and payment, compromising the steps of:

creating a mail batch including a plurality of mailpieces;

creating a statement of mailing containing data relating to said mail batch;

digitally signing said statement of mailing to facilitate a subsequent verification of the integrity of the data in said statement of mailing, said digital signature included as part of said statement of mailing;

submitting said statement of mailing to a transaction processing center;

said transaction processing center authenticating the signed statement of mailing and then initiating a funds transfer to a carrier delivery service for carrier delivery services payment for said batch of mail;

delivering the mail batch to the carrier delivery service upon confirmation by the transaction processing center and storing said statement of mailing in a nonvolatile memory means, said nonvolatile memory means allowing said statement of mailing to be stored therein and erased therefrom but not modified.

10. A method for mail accounting and payment as defined in claim 9 further including the step of said transaction processing center submitting a confirmation of acceptance or nonacceptance of said statement of mailing to the submitter of said statement of mailing.

11. A method for mail accounting and payment as defined in claim 10 wherein said submitting of said confirmation of acceptance or nonacceptance of said statement of mailing to the submitter of said statement of mailing occurs after said transaction processing center has created a request for funds transfer from said mailer's financial institution to said carrier's financial institution and has received a confirmation of funds transfer.

12. A method for mail accounting and payment as defined in claim 11 wherein each mail piece of said plurality of mail pieces has an encrypted indicia printed thereon.

13. A method for mail accounting and payment as defined in claim 12 wherein said steps of submitting are electronic communications between said submitter of said statement of mailing, transaction processing center and said carrier service.

14. A method for mail accounting and payment as defined in claim 13 further including the step of submitter of said statement of mailing additionally submitting said statement of mailing to said carrier service.

15. A method for mail accounting and payment as defined in claim 14 further including the step of said carrier service submitting information to said transaction processing center and said transaction processing center submitting said information to said submitter of said statement of mailing.

* * * * *